United States Patent [19]

Williams et al.

[11] Patent Number: 4,797,954

[45] Date of Patent: Jan. 17, 1989

[54] SHIRT WITH SECURITY CLOTH

[76] Inventors: Ruth L. Williams, 289 NE. 8th St., Linton, Ind. 47441; Thelma M. Orman, 913 Lankford St., Clay City, Ind. 47841

[21] Appl. No.: 104,650

[22] Filed: Oct. 5, 1987

[51] Int. Cl.[4] ..... A41D 1/22

[52] U.S. Cl. ..... 2/106; 2/118; 450/31

[58] Field of Search ..... 2/118, 119, 74, 73, 2/103–104, 105, 106, 109; 450/11, 31–33

[56] References Cited

U.S. PATENT DOCUMENTS

| | | | |
|---|---|---|---|
| 639,440 | 12/1899 | Rutenberg | 2/105 |
| 681,821 | 9/1901 | Tomlin | 2/103 |
| 905,270 | 12/1908 | Abrahann | 2/118 |
| 1,254,043 | 1/1918 | James | 450/31 |
| 1,843,717 | 2/1932 | Grifenhagen | 2/106 |
| 1,895,237 | 1/1933 | Staw | 2/119 |

*Primary Examiner*—Ronald Feldbaum

*Attorney, Agent, or Firm*—Woodard, Emhardt, Naughton, Moriarty & McNett

[57] ABSTRACT

A shirt including an interior panel preventing the shirt from becoming open. A security cloth having opposite ends is fastened to the vertical seams of the shirt which extend downwardly from the arm holes. The security cloth includes top ends fastened to seams extending on the shirt from the uppermost portion of the arm holes to the neck opening. Fastening means in the middle of the security cloth allow the security cloth to be opened and closed when the shirt is put on and taken off.

9 Claims, 1 Drawing Sheet

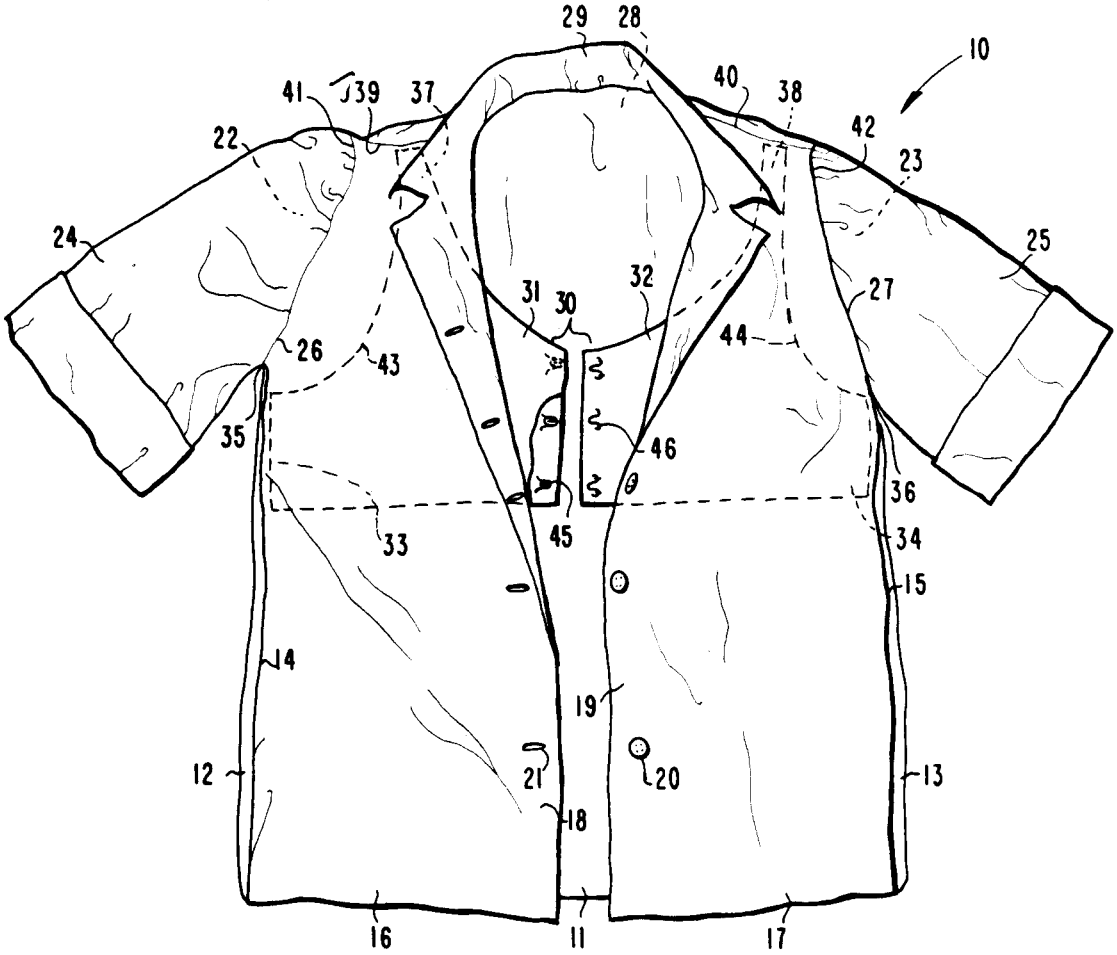
10
11
12
13
14
15
16
17
18
19
20
21
22
23
24
25
26
27
28
29
30
31
32
33
34
35
36
37
38
39
40
41
42
43
44
45
46

SHIRT WITH SECURITY CLOTH

BACKGROUND OF THE INVENTION

This invention is in the field of clothing and more specifically involves any garment opening in the front. A variety of articles of clothing have been designed to provide a multilayer look. An early design of a combination outer garment and inner garment is shown in U.S. Pat. No. 533,994 issued to Marcus Loewenthal. Later designs such as shown in U.S. Pat. Nos. 2,556,039 issued to Pauline Landert and 4,343,046 issued to Diane Zebell disclose an outer vest portion which extends over a shirt or blouse. A blouse having the general appearance of an outer coat with a V-shaped front opening is disclosed in U.S. Pat. Des. 101,756 issued to Albert Einstein.

Most shirts or blouses have a front portion which may be opened by buttons, hooks, zippers or other attachment means allowing the shirt to be put on or taken off. A common occurrence is for the button or other attaching means to become accidentally opened allowing visual observation through the opening. Such an accidental opening is particularly true with large chested women. We have therefore designed a multilayer shirt including an inner layer of cloth attached to the shirt forming a security cloth across the chest of the wearer preventing the shirt or blouse from coming unfastened.

SUMMARY OF THE INVENTION

One embodiment of the present invention is a shirt comprising a shirt main body configured to fit around a wearer's upper torso and having a front chest portion with a pair of separable front edges, the shirt main body including first fastening means extending down the front chest portion on the separable front edges and operable to allow the front edges to be separated when the shirt is being put on and taken off the wearer and to be closed together once the shirt is on the wearer, the shirt main body having two attachment areas separated by a first distance; and, a security cloth enclosed within the main body and having opposite ends fastened to the two attachment areas, the security cloth located inwardly of and across the front chest portion immediately adjacent the fastening means and extending internally across the front edges to prevent the shirt from coming unfastened.

A further embodiment of the present invention is a shirt comprising a shirt main body including a back panel and two front panels with adjacent edges, the back panel together with the two front panels forming a neck opening and a pair of arm holes; first fastening means on the two front panels and located at the adjacent edges being operable to detachably fasten the edges together; and, a security cloth fastened to the shirt main body immediately beneath the pair of arm holes and extending across the adjacent edges between the back panel and the two front panels preventing the shirt from coming unbuttoned or unfastened.

It is an object of the present invention to provide a shirt or blouse having a security cloth extending across the wearer's chest preventing the shirt from becoming unfastened.

Related objects of the present invention will be apparent in the following description.

BRIEF DESCRIPTION OF THE DRAWING

The drawing is a front view of a shirt or blouse incorporating the present invention.

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to the drawing, there is shown a blouse or shirt 10 incorporating the present invention. Shirt 10 includes a back panel 11 having opposite vertically extending edge portions 12 and 13 sewn or joined along seams 14 and 15 respectively to the outer edge portions of the two front panels 16 and 17 of the shirt. The two front panels 16 and 17 also have a pair of inner edge portions 18 and 19 detachably or releasably secured together by conventional fastening means extending along the edges 18 and 19. In the embodiment shown in the drawing, a plurality of buttons 20 are mounted on edge portion 19 and are extendable through corresponding button holes 21 provided on edge portion 18.

The two front panels 16 and 17 cooperatively with the back panel 11 form a pair of arm holes 22 and 23 from which a pair of sleeves 24 and 25 extend. The sleeves are attached respectively via seams 26 and 27 to the front panels and back panel. A neck opening 28 is cooperatively formed by the two front panels 16 and 17 and the back panel 11 with a collar 29 extending partially around neck opening 28 and attached via a seam to the front panels and back panel. Such a shirt as described to this point of the specification is quite conventional.

We have invented a security cloth 30 enclosed within the shirt main body to extend across the chest to prevent the outer edges from opening. In the embodiment shown in the drawing, the security cloth includes two separate pieces of cloth 31 and 32 with their adjacent edges detachably secured together and their opposite ends fixedly attached to the shirt at the location of various seams.

Security cloth 30 has two opposite side ends 33 and 34 fastened respectively to side seams 14 and 15 and extend vertically downward respectively from the lowermost areas 35 and 36 of arm holes 22 and 23. Further, each piece 31 and 32 have respectively top ends 37 and 38 attached respectively to seams 39 and 40 extending from respectively the uppermost areas 41 and 42 of arm holes 22 and 23 to neck opening 28. Seams 39 and 40 join the top edge of back panel 11 with the top edge portions of front panels 16 and 17 in the areas between the arm holes and the neck opening. Typically, arm holes 22 and 23 are circular in configuration with seams 14 and 15 extending downwardly from the lowermost portion of the circular arm holes. Likewise, seams 39 and 40 extend from the uppermost portions of the circular arm holes toward neck opening 28. Security pieces 31 and 32 have respectively curved ends 43 and 44 extending respectively from top ends 37, 38 to side ends 33, 34. Sides 43 and 44 extend through curves which are larger than arm holes 22 and 23 thereby preventing the security cloth 30 from binding on the wearer's arm and chest. That is, sides 43 and 44 extend thru curved paths located outward of the circular arm holes. Since the security cloth 30 is located between the back panel 11 and front panels 16 and 17, the overall length of the security cloth from side end 33 to side end 34 is less than the distance of the front panels from seam 14 to seam 15 when the front panels are secured together and the cloth pieces 31 and 32 are secured together. If the shirt is placed in a stress condition, that is, if the shirt is pulled in a horizontally direction normally placing stress on the fastening means closing the front panels of the shirt together, then the security cloth will absorb the strees thereby isolating the front panels 16 and 17 from the stress. Conventional fastening means such as a plurality of interlocking hooks 45 and 46 are provided on the adjacent edges of cloth pieces 31 and 32 to enable the security cloth to be opened and closed allowing the garment to be put on and taken off by the wearer. The security cloth is attached to the shirt only along seams 14, 15, 39 and 40, thereby allowing movement of the security cloth relative to the shirt main body when the person's upper torso is located between back panel 11 and security cloth 30. The opposite side ends 33 and 34 of the security cloth are fastened to the side seams 14 and 15 in an area immediately beneath the arm holes whereas the top ends 37 and 38 of the security cloth are fastened to the shirt main body immediately above the arm holes, thereby providing for a comfortable fit and attractive appearance.

Many advantages will be apparent from the above description. Most importantly, the security cloth extends internally across and behind the front edges of the shirt front panels thereby preventing the garment from becoming unfastened.

While the invention has been illustrated and described in detail in the drawing and foregoing description, the same is to be considered as illustrative and not restrictive in character, it being understood that only the preferred embodiment has been shown and described and that all changes and modifications that come within the spirit of the invention are desired to be protected.

What is claimed is:

1. A shirt comprising:

a shirt main body configured to fit around a wearer's upper torso and having a front chest portion and a back portion joined together to completely encircle the wearer, said shirt main body including a pair of front panels and a pair of separable front edges, and further including first fastening means extending down said front chest portion on said separable front edges operable to allow the front edges to be separated when the shirt is being put on and taken off the wearer and to be closed together once the shirt is on the wearer, said shirt main body having two attachment areas separated by a first distance on said front panels when said front edges are closed together; and, a security cloth enclosed within said main body and extending only partially around the wearer, said cloth having opposite ends fastened to said two attachment areas, said security cloth located inwardly of and extending only adjacent and across said front chest portion, immediately adjacent said fastening means and internally across said front edges to prevent the shirt main body from separating when the shirt is on the wearer located between and separating said security cloth and said back portion apart, said security cloth has a length between said opposite ends shorter than said first distance terminating forward of said back portion with the wearer's chest protruding forward against said security cloth pulling said back portion forwardly toward the wearer's back and isolating said front panels and fastening means from stress.

2. The shirt of claim 1 and further comprising:

second fastening means mounted on said security cloth being operable to separate said security cloth into at least two pieces allowing the security cloth to be opened when the shirt is put on the wearer.

3. The shirt of claim 1 wherein: said security cloth is located between said back portion and said front chest portion but spaced apart from said back portion when the shirt is worn.

4. The shirt of claim 1 wherein:

said shirt main body includes a pair of arm holes with said two attachment areas located immediately beneath said arm holes.

5. The shirt of claim 4 wherein:

said security cloth includes a pair of top ends extending upwardly and fastened to said shirt main body above said pair of arm holes.

6. The shirt of claim 1 and further comprising:

second fastening means mounted on said security cloth being operable to separate said security cloth into at least two pieces allowing the security cloth to be opened when the shirt is put on the wearer; and wherein:

said back portion extends lengthwise with said front chest portion with said security cloth located therebetween but spaced apart from said back portion when the shirt is worn and further includes a pair of arm holes with said two attachment areas located immediately beneath said arm holes;

said security cloth includes a pair of top ends extending upwardly and fastened to said shirt main body above said pair of arm holes.

7. The shirt of claim 4 wherein:

said back portion includes a pair of vertically extending edge portions connected to said front panels forming a pair of side seams with said security cloth having a pair of opposite side ends fastened to said side seams immediately beneath said pair of arm holes, said back portion further includes a top edge portion connected to said front panels forming a pair of top seams with said security cloth having a pair of top ends fastened to said top seams immediately above said arm holes.

8. The shirt of claim 7 wherein:

said side seams extend downwardly from the lowermost area of said arm holes and said top seams extend from the uppermost area of said arm holes, said security cloth has opposite sides extending curvingly through a curve larger than said arm holes from said top ends to said side ends.

9. The shirt of claim 8 and further comprising:

second fastening means mounted on said security cloth being operable to separate said security cloth into at least two pieces allowing the security cloth to be opened when the shirt is put on the wearer.

* * * * *